US011319941B2

(12) United States Patent
Jeong

(10) Patent No.: US 11,319,941 B2
(45) **Date of Patent: *May 3, 2022**

(54) LINEAR COMPRESSOR

(71) Applicant: LG ELECTRONICS INC., Seoul (KR)

(72) Inventor: Sangsub Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/118,785

(22) Filed: Dec. 11, 2020

(65) Prior Publication Data

US 2021/0095655 A1 Apr. 1, 2021

Related U.S. Application Data

(63) Continuation of application No. 15/890,464, filed on Feb. 7, 2018, now Pat. No. 10,890,169.

(30) Foreign Application Priority Data

Feb. 10, 2017 (KR) ..... 10-2017-0018598

(51) Int. Cl.
*F04B 35/04* (2006.01)
*F04B 39/12* (2006.01)
(Continued)

(52) U.S. Cl.
CPC ..... *F04B 35/045* (2013.01); *F04B 39/0016* (2013.01); *F04B 39/0061* (2013.01); *F04B 39/0292* (2013.01); *F04B 39/10* (2013.01); *F04B 39/102* (2013.01); *F04B 39/121* (2013.01); *F04B 39/122* (2013.01);
(Continued)

(58) Field of Classification Search
None
See application file for complete search history.

(56) References Cited

U.S. PATENT DOCUMENTS 2,872,102 A 2/1959 Ryba
3,007,625 A 11/1961 Dölz
(Continued)

FOREIGN PATENT DOCUMENTS

CN 101324224 12/2008
DE 10 2013 221 735 4/2015
(Continued)

OTHER PUBLICATIONS

International Search Report dated May 30, 2018.
(Continued)

*Primary Examiner* — Charles G Freay
(74) *Attorney, Agent, or Firm* — Ked & Associates LLP

(57) ABSTRACT

A linear compressor is provided. The linear compressor may include a cylinder that defines a compression space for a refrigerant; a piston that axially reciprocates inside the cylinder; a motor configured to provide a drive force to the piston; a discharge valve configured to discharge the refrigerant compressed in the compression space; and a discharge cover having a discharge space in which the refrigerant discharged through the discharge valve flows. The discharge valve and the discharge cover may be arranged inside the motor.

15 Claims, 9 Drawing Sheets

(51) Int. Cl.

| | |
|---|---|
| ***F04B 39/10*** | (2006.01) |
| ***F04B 39/00*** | (2006.01) |
| ***F04B 39/02*** | (2006.01) |
| ***F04B 53/00*** | (2006.01) |
| ***F04B 53/08*** | (2006.01) |
| ***F04B 53/10*** | (2006.01) |
| ***F04B 53/16*** | (2006.01) |

(52) U.S. Cl.
CPC ..... *F04B 39/126* (2013.01); *F04B 53/008* (2013.01); *F04B 53/08* (2013.01); *F04B 53/10* (2013.01); *F04B 53/16* (2013.01)

(56) References Cited

U.S. PATENT DOCUMENTS

| | | | | |
|---|---|---|---|---|
| 3,788,778 | A * | 1/1974 | Miller | F04B 35/045 417/417 |
| 4,775,301 | A | 10/1988 | Cartwright et al. | |
| 7,316,545 | B2 | 1/2008 | Lenke | |
| 9,004,883 | B2 | 4/2015 | Neelakantan et al. | |
| 9,145,878 | B1 | 9/2015 | McKenzie et al. | |
| 9,494,148 | B2 * | 11/2016 | Ahn | F04B 39/0276 |
| 10,890,169 | B2 * | 1/2021 | Jeong | F04B 39/0016 |
| 2004/0146417 | A1 | 7/2004 | Dunn | |
| 2005/0063841 | A1 | 3/2005 | Chen et al. | |
| 2009/0081054 | A1 | 3/2009 | Kang et al. | |
| 2010/0247308 | A1 * | 9/2010 | Giacchi | B23K 26/0626 415/229 |
| 2010/0260629 | A1 | 10/2010 | Kang et al. | |
| 2013/0058815 | A1 | 3/2013 | Kim | |
| 2013/0058816 | A1 | 3/2013 | Kim | |
| 2014/0053720 | A1 | 2/2014 | Ahn et al. | |
| 2015/0219095 | A1 * | 8/2015 | Muhle | F04B 39/121 92/169.1 |
| 2015/0369224 | A1 | 12/2015 | Kim et al. | |
| 2016/0097387 | A1 * | 4/2016 | Hiratsuka | F04B 39/127 417/545 |

FOREIGN PATENT DOCUMENTS

| | | |
|---|---|---|
| EP | 1 556 613 | 7/2005 |
| JP | 2001-221159 | 8/2001 |
| JP | 2011-52649 | 3/2011 |
| KR | 10-1998-050599 | 9/1998 |
| KR | 10-2003-0020281 | 3/2003 |
| KR | 10-0492612 | 5/2005 |
| KR | 10-2016-0010999 | 1/2016 |

OTHER PUBLICATIONS

European Search Report dated Jul. 2, 2018.
European Search Report dated Sep. 25, 2018.
U.S. Office Action issued in U.S. Appl. No. 15/890,464 dated Jan. 8, 2020.
U.S. Office Final Action issued in U.S. Appl. No. 15/890,464 dated Apr. 9, 2020.
U.S. Office Action issued in U.S. Appl. No. 15/890,464 dated Jun. 26, 2020.
U.S. Notice of Allowance issued in U.S. Appl. No. 15/890,464 dated Sep. 10, 2020.

* cited by examiner

LINEAR COMPRESSOR

CROSS-REFERENCE TO RELATED PATENT APPLICATIONS

This application is a Continuation Application of prior U.S. patent application Ser. No. 15/890,464 filed Feb. 7, 2018, which claims priority under 35 U.S.C. § 119 to Korean Application No. 10-2017-0018598 filed in Korea on Feb. 10, 2017, whose entire disclosures are hereby incorporated by reference.

BACKGROUND

1. Field

A linear compressor is disclosed herein.

2. Background

In general, a compressor, which is a machine configured to receive power from a power generating device, such as an electric motor and a turbine, and increase pressure by compressing air, refrigerant, or various other operating gases, has been widely used in home appliances, such as a refrigerator and an air conditioner or throughout the industry. Such a compressor may be roughly classified into a reciprocating compressor, a rotary compressor, and a scroll compressor.

The reciprocating compressor may be a compressor in which a compression space into and from which an operating gas is suctioned and discharged is defined between a piston and a cylinder and the piston linearly reciprocates inside the cylinder to compress a refrigerant. The rotary compressor may be a compressor in which a compression space into and from which an operating gas is suctioned and discharged is defined between an eccentrically rotated roller and a cylinder and the roller is eccentrically rotated along an inner wall of the cylinder to compress a refrigerant. The scroll compressor may be a compressor in which a compression space into and from which an operating gas is suctioned and discharged is defined between an orbiting scroll and a fixed scroll and the orbiting scroll is rotated along the fixed scroll to compress a refrigerant.

In recent years, among the reciprocating compressor, a linear compressor has actively been developed in which a piston is directly connected to a linearly reciprocating drive motor so that compression efficiency may be improved without mechanical loss by movement conversion, and the linear compressor has a simple structure. In general, the linear compressor is configured to suction, compress, and then discharge a refrigerant while a piston linearly reciprocates inside a cylinder by a linear motor inside a sealed shell.

For example, the linear motor is configured such that a permanent magnet is located between an inner stator and an outer stator, and the permanent magnet is driven to linearly reciprocate by a mutual electromagnetic force between the permanent magnet and the inner (or outer) stator. Further, as the permanent magnet is driven while being connected to the piston, the piston linearly reciprocates inside the cylinder to suction, compress, and then discharge a refrigerant.

Such a linear compressor is disclosed in Korean Patent No. 10-0492612 (hereinafter referred to as "related art document"), which is hereby incorporated by reference. In the related art document, mechanical resonance springs, which are compression coil springs, are provided on opposite sides of a piston in a reciprocating direction such that a mover connected to the piston may stably reciprocate.

Accordingly, when the mover moves forward/rearward in a direction of a magnetic flux of electric power applied to a permanent magnet, a series of processes are repeated in which a mechanical resonance spring provided in a direction in which the mover moves accumulates a repulsive force while being compressed, and next the mechanical resonance spring having accumulated the repulsive force pushes the mover when the mover moves in an opposite direction.

Meanwhile, in a linear compressor according to the related art, a discharge valve assembly including a discharge valve, a discharge spring, and a muffler through which a refrigerant compressed by a cylinder is to be discharged is located outside a cylinder. That is, because the discharge valve assembly is formed outside a linear motor in a longitudinal direction of a piston, a length of a shell of the compressor increases, and thus, an entire size of the compressor increases.

Further, when a cross section of a coil increases in order to increase an output of a motor in a state in which a size of a linear motor is limited, a length of the piston as well as a length of the motor should increase. Thus, when the piston is lengthened, a weight of a mover increases, and accordingly, a high-speed operation becomes disadvantageous.

BRIEF DESCRIPTION OF THE DRAWINGS

Embodiments will be described in detail with reference to the following drawings in which like reference numerals refer to like elements, and wherein.

DETAILED DESCRIPTION

Figure 1:
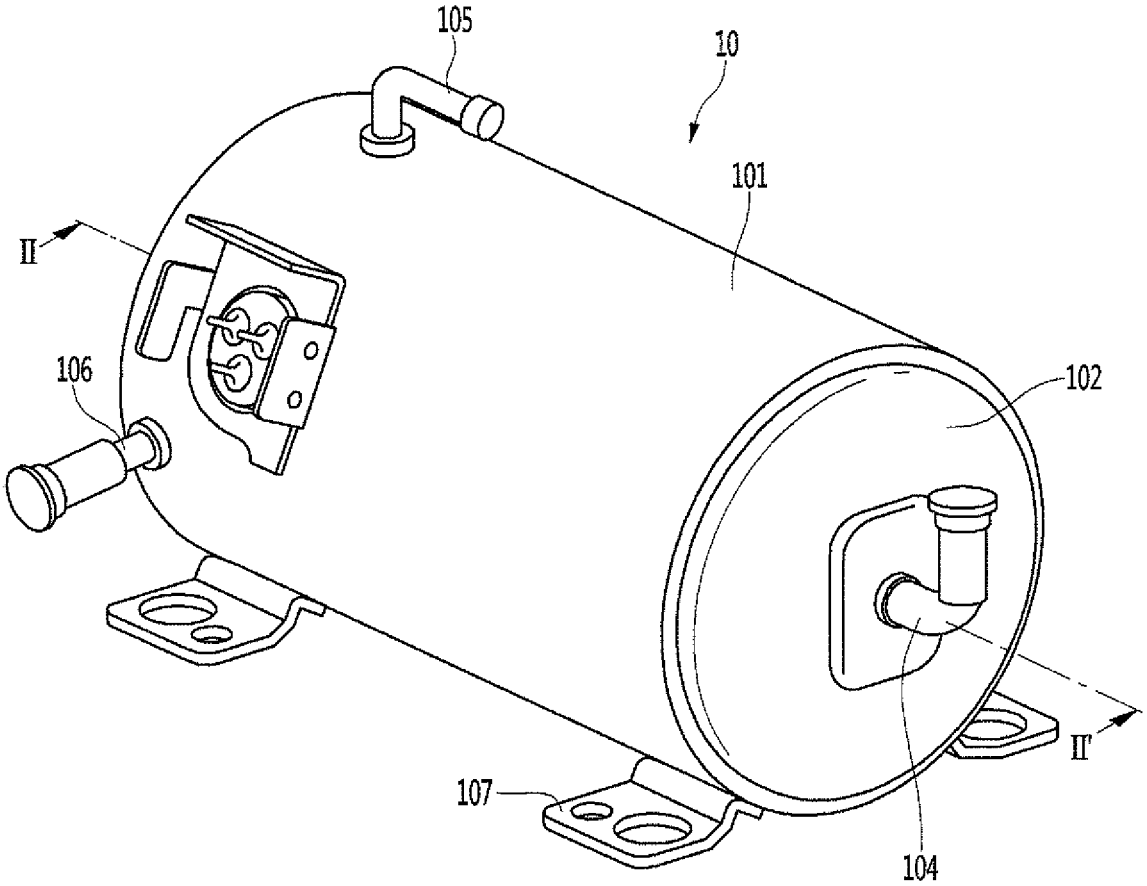
FIG. 1 is a perspective view illustrating an outer appearance of a linear compressor according to an embodiment.

Reference will now be made to embodiments, examples of which are illustrated in the accompanying drawings. Where possible, like reference numerals have been used to indicate like elements, and repetitive disclosure has been omitted.

FIG. 1 is a perspective view illustrating an outer appearance of a linear compressor according to an embodiment. Referring to FIG. 1, a linear compressor 10 according to the embodiment may include a shell 101 and shell covers 102 and 103 coupled to the shell 101. In a broad sense, the shell covers 102 and 103 may be understood as one configuration of the shell 101.

Legs 107 may be coupled to a lower portion of the shell 101. The legs 107 may be coupled to a base of a product in which the linear compressor 10 is installed. For example, the base may include a base of a machine room of a refrigerator. As another example, the product may include an outdoor unit for an air conditioner, and the base may include a base for the outdoor unit.

The shell 101 may have an approximately cylindrical shape, and may be arranged to be laid transversely or axially. Referring to FIG. 1, the shell 101 may transversely extend, and may have a slightly low height in a radial direction. That is, the linear compressor 10 may have a low height, so that there is an advantage in that when the linear compressor 10 is installed in the base for the machine room or the outdoor unit of the refrigerator, the height of the machine room may be reduced.

Opposite sides of the shell 101 may be open. The shell covers 102 and 103 may be coupled to the open opposite sides of the shell 101.

The shell covers 102 and 103 may include a first shell cover 102 coupled to one or a first open side of the shell 101 and a second shell cover 103 coupled to the open other or a second side of the shell 101. An inner space of the shell 101 may be sealed by the shell covers 102 and 103.

Referring to FIG. 1, the first shell cover 102 may be located on a right or lateral side of the linear compressor 10, and the second shell cover 103 may be located on a left or lateral side of the linear compressor 10. In other words, the first and second shell covers 102 and 103 may be arranged to face each other.

The linear compressor 10 may further include a plurality of pipes 104, 105, and 106 provided in the shell 101 or the shell covers 102 and 103 to suction, discharge, or inject a refrigerant. The plurality of pipes 104, 105, and 106 may include a suction pipe 104 through which the refrigerant may be suctioned into the linear compressor 10, a discharge pipe 105 through which the compressed refrigerant may be discharged from the linear compressor 10, and a process pipe 106 through which the refrigerant may be supplemented to the linear compressor 10.

For example, the suction pipe 104 may be coupled to the first shell cover 102. The refrigerant may be suctioned into the linear compressor 10 along an axial direction through the suction pipe 104.

The discharge pipe 105 may be coupled to the shell 101. The refrigerant suctioned through the suction pipe 104 may be compressed while flowing in an axial direction. Further, the compressed refrigerant may be discharged through the discharge pipe 105. The discharge pipe 105 may be arranged to be closer to the second shell cover 103 than the first shell cover 102.

The process pipe 106 may be coupled to an outer circumferential surface of the shell 101. A worker may inject the refrigerant into the linear compressor 10 through the process pipe 106.

The process pipe 106 may be coupled to the shell 101 at a height which is different from a height of the discharge pipe 105, to avoid interference with the discharge pipe 105. The height is understood as a distance from the leg 107 in a vertical direction (or a radial direction). The discharge pipe 105 and the process pipe 106 may be coupled to the outer circumferential surface of the shell 101 at different heights, so that work convenience may be achieved.

Figure 2:
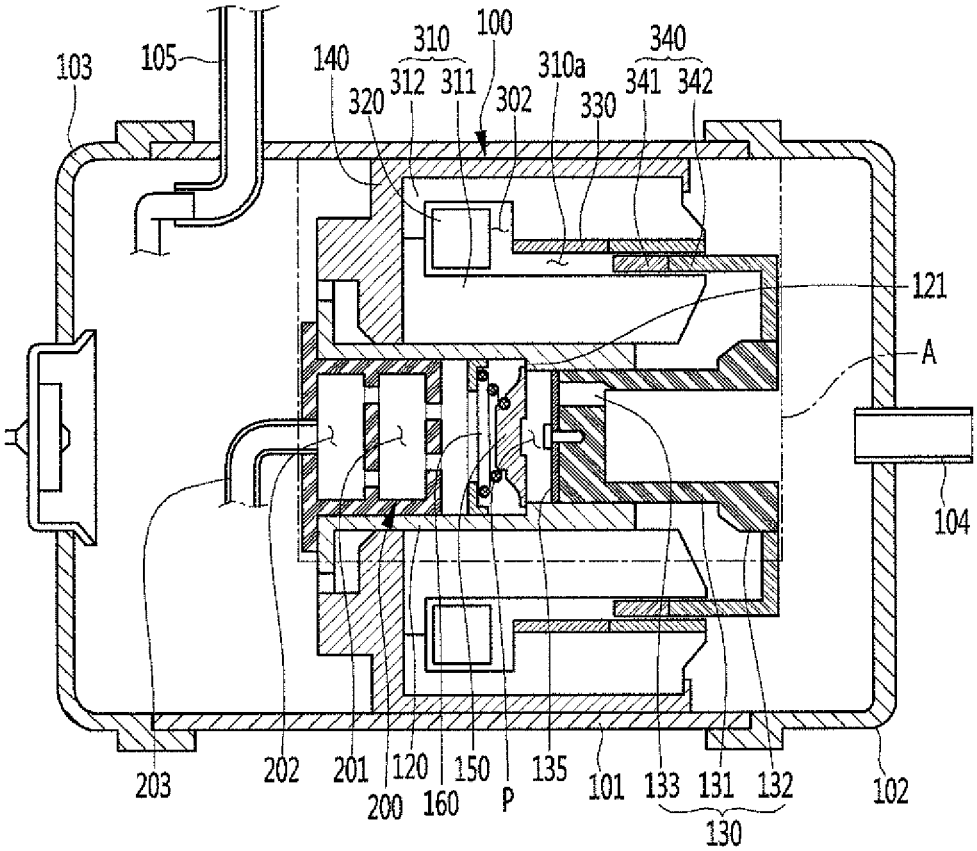
FIG. 2 is a sectional view taken along line II-II' of FIG. 1.
Figure 3:
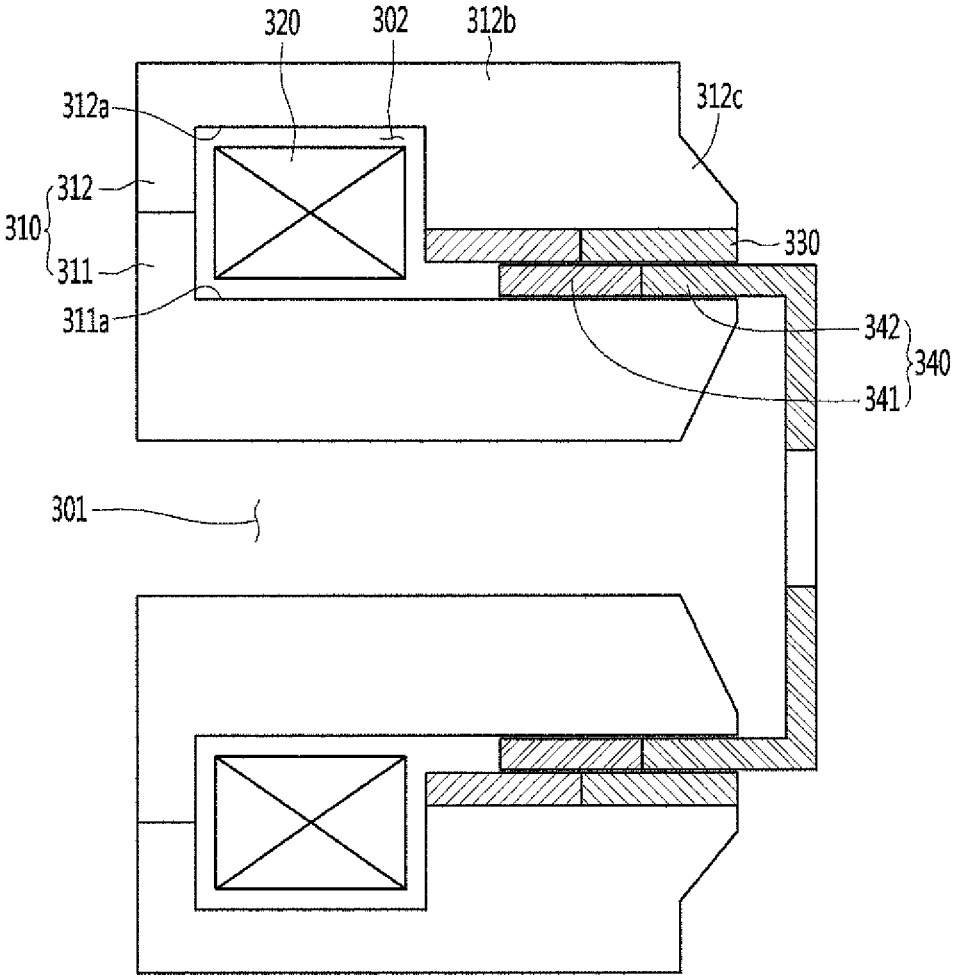
FIG. 3 is a view of a linear motor according to an embodiment.
Figure 4:
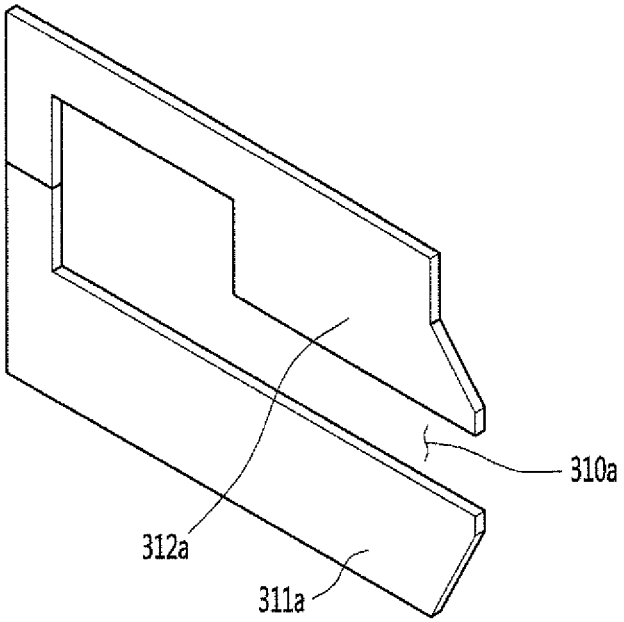
FIG. 4 is a view illustrating a core block constituting a stator of the linear motor according to an embodiment.

FIG. 2 is a sectional view taken along line II-II' of FIG. 1. FIG. 3 is a view of a linear motor according to an embodiment. FIG. 4 is a view illustrating a core block constituting a stator of the linear motor according to an embodiment.

Referring to FIGS. 2 to 4, the linear compressor 10 according to this embodiment may include a compressor body 100. The compressor body 100 may be supported on one or more of the shell 101 and the shell covers 102 and 103 by a support device (not illustrated).

The compressor body 100 may include a cylinder 120 provided inside the shell 101 and a piston 130 that linearly reciprocates inside the cylinder 120. The cylinder 120 may accommodate at least a portion of a piston body 131. The cylinder 120 may be located inside a motor 300 which will be described hereinafter.

A compression space P in which the refrigerant may be compressed by the piston 130 may be formed inside the cylinder 120. For example, the cylinder 120 may be formed to have a hollow cylindrical shape. Further, the compression space P may be formed by inserting the piston 130 into one open side of the cylinder 120.

A stepped portion or step 121 may be formed inside the cylinder 120. The stepped portion 121 may be formed by a difference in an inner diameter of the cylinder 120.

For example, the stepped portion 121 may be formed at an approximately central point of an inner circumferential surface of the cylinder 120. That is, as illustrated in FIG. 2, a left or first lateral inner diameter of the cylinder 120 may be larger than a right or second lateral inner diameter of the cylinder 120 with respect to a center of the cylinder 120. Thus, the stepped portion 121 may be formed by a difference between the left inner diameter and the right inner diameter. A discharge valve 150, which will be described hereinafter, may be arranged in the stepped portion 121.

The piston 130 may include an approximately cylindrical piston body 131 and a flange 132 that extends radially from the piston body 131. The piston body 131 may be accommodated in the cylinder 120 and may reciprocate inside the cylinder 120. A suction hole 133 through which the refrigerant may be introduced into the compression space P of the cylinder 120 may be formed on a front surface of the piston body 131.

The flange 132 may be formed at an end of the piston body 131 and may be located outside the cylinder 130. The flange 132 may reciprocate outside the cylinder 120.

The compressor body 100 may further include a suction valve 135 provided in front of the suction hole 133. The suction valve 135 may be located inside the motor 300.

The suction valve 135 may be arranged in front of the suction hole 133 to function to selectively open the suction hole 133. Further, a fastening hole to which a fastening member configured to fasten the suction valve 135 to the front surface of the piston body 131 is coupled may be formed at an approximately central portion of the suction valve 135.

The compressor body 100 may further include a suction muffler (not illustrated). The suction muffler may be coupled to the piston 130 to reduce noise generated due to the refrigerant suctioned through the suction pipe 104.

Thus, the refrigerant suctioned through the suction pipe 104 may flow into the piston 130 via the suction muffler. While the refrigerant passes through the suction muffler, flow noise of the refrigerant may be reduced.

An "axial direction" may be understood as a direction in which the piston 130 reciprocates, that is, a transverse direction in FIG. 2. Further, in the "axial direction", a direction from the suction pipe 104 to the compression space P, that is, a direction in which the refrigerant flows, is defined as a "forward direction", and a direction that is opposite thereto is defined as a "rearward direction". On the other hand, a "radial direction" may be understood as a direction perpendicular to the direction in which the piston 130 reciprocates, that is, a vertical direction in FIG. 2.

The compressor body 100 may further include the discharge valve 150 provided in front of the compression space P. The discharge valve 150 may be located inside the motor 300.

The discharge valve 150 may function to selectively discharge the refrigerant compressed in the compression space P. The discharge valve 150 may be arranged inside the cylinder 120.

The discharge valve 150 may be arranged at a front end of the cylinder 120 to seal the compression space P. In this case, an outer circumferential surface of the discharge valve 150 may be spaced apart from the inner circumferential surface of the cylinder 120.

The compressor body 100 may further include a spring assembly 160 that elastically supports the discharge valve 150. The spring assembly 160 may be arranged inside the cylinder 120, and provide an axial elastic force to the discharge valve 150. For example, the spring assembly 160 may include a leaf spring and a spring supporter that supports the same.

The compressor body 100 may further include a discharge cover 200 that defines discharge spaces 201 and 202 for the refrigerant discharged from the compression space P. The discharge cover 200 may be arranged inside the motor 300. Alternatively, the discharge cover 200 may be arranged inside the cylinder 120. The discharge cover 200 may be arranged in front of the spring assembly 160 to guide flow of the refrigerant discharged by the discharge valve 150.

As in the above-described structure, in embodiments, components configured to discharge the refrigerant compressed in the compression space P, that is, the discharge valve 150, the spring assembly 160, and the discharge cover 200, may be arranged inside the cylinder 120.

The discharge cover 200 will be described hereinafter.

A rear portion or a rear surface of the discharge valve 150 may be supportably located on a front surface of the stepped portion 121. That is, when the discharge valve 150 is supported on the front surface of the stepped portion 121, the compression space P may be maintained in a sealed state. When the discharge valve 150 is spaced apart from the front surface of the stepped portion 121, the compression space P may be opened so that the refrigerant compressed in the compression space P may be discharged.

The compression space P may be a space formed between the suction valve 135 and the discharge valve 150. Further, the suction valve 135 may be provided on one or a first side of the compression space P, and the discharge valve 150 may be provided on the other or a second side of the compression space P, that is, on a side opposite to the suction valve 135.

While the piston 130 linearly reciprocates inside the cylinder 120, when the pressure of the compression space P is lower than a discharge pressure and is not more than a suction pressure, the suction valve 135 is opened so that the refrigerant is suctioned into the compression space P. On the other hand, when the pressure of the compression space P is not less than the suction pressure, in a state in which the suction valve 135 is closed, the refrigerant of the compression space P is compressed.

Further, when the pressure of the compression space P is not less than the discharge pressure, the discharge valve 150 is opened. At this time, the refrigerant is discharged from the compression space P to the discharge spaces 201 and 202 of the discharge cover 200. When the refrigerant is completely discharged to the discharge spaces 201 and 202, the discharge valve 150 is closed by a spring restoring force of the spring assembly 120.

The compressor body 100 may further include a cover pipe 203 configured to discharge the refrigerant having passed through the discharge spaces 201 and 202 of the discharge cover 200. The cover pipe 230 may be coupled to one side of the discharge cover 200. The compressor body 100 may further include a loop pipe (not illustrated) configured to transfer the refrigerant flowing through the cover pipe 203 to the discharge pipe 105. One or a first side of the loop pipe may be coupled to the cover pipe 203, and the other or a second side of the loop pipe may be coupled to the discharge pipe 105.

The compressor body 100 may further include a frame 140. The frame 140 may support the cylinder 120 and the motor 300, which will be described hereinafter. For example, the cylinder 120 may be press-fitted into the frame 140.

The frame 140 may be arranged to surround the cylinder 120. That is, the cylinder 120 may be located to be accommodated inside the frame 140. At this time, the discharge cover 200 may be coupled to the front surface of the frame 140 or the front surface of the cylinder 120 through the fastening member.

The compressor body 100 may further include the motor 300 configured to provide a drive force to the piston 130. When the motor 300 is driven, the piston 130 may axially reciprocate inside the cylinder 120.

The motor 300 may include a stator 310, a magnet coil 302, a magnet 330, and a mover 340. The stator 310 may include an inner stator 311 and an outer stator 312 connected to the inner stator 311 on one or a first side thereof and spaced and arranged on a radial outer side of the inner stator 311 such that the other or a second side of the outer stator 312 and the other side of the inner stator 311 define an air gap 310*a*.

The inner stator 311 may be fixed to the frame 140 to surround the cylinder 120. Further, the outer stator 312 may be fixed to the frame 140 and may be spaced inward apart from the inner stator 311.

The inner stator 311 and the outer stator 312 may be formed of a magnetic material or a conductive material, for example. In this embodiment, the inner stator 311 may be formed by radially stacking inner core blocks 311*a*, and the outer stator 312 may be formed by radially stacking outer core blocks 312*a*.

As illustrated in FIG. 4, the inner core blocks 311*a* and the outer core blocks 312*a* may have a form of a thin fin such that (first) sides thereof are connected to each other and the other (second) sides thereof are spaced apart from each other so that the air gap 310*a* is formed. As above, when the inner core blocks 311*a* and the outer core blocks 312*a* are radially stacked on each other, the inner stator 311 and the outer stator 312 may have a circular shape when viewed in an axial direction, and may have a hollow cylindrical shape as a whole. In this case, the air gap 310*a* formed between the inner stator 311 and the outer stator 312 may also have a cylindrical shape as a whole.

In this embodiment, at least one of the inner core blocks 311*a* or the outer core blocks 312*a* may have an "I" shape, an "L" shape, or a "U" shape, or various other shapes. For example, the inner core blocks 311*a* and the outer core blocks 312*a*, which are integrally connected, may have an approximately "U" shape.

The magnet coil 320 may be wound between the inner stator 311 and the outer stator 312 or may be accommodated in a wound state.

In this embodiment, the magnet coil 320 may be connected to the inner stator 311 while being wound on the inner stator 311. In this case, after the magnet coil 320 is wound on the inner stator 311, the outer stator 312 may be fixed to the inner stator 311.

Alternatively, the magnet coil 320 may be fixed to the inner stator 311 and the outer stator 312 after being separately wound. In this case, the inner stator 311 may be formed by radially stacking the plurality of inner core blocks 311*a* on an inner circumferential surface of the wound magnet coil 320. Further, the outer stator 312 may be also formed by radially stacking the plurality of outer core blocks 312*a* on an outer circumferential surface of the wound magnet coil 320.

The inner stator 311 may define a hollow 301 by the above-described radially-stacked inner core blocks 311*a*. Further, the hollow 301 may be utilized as a space where the piston 130, and the cylinder 120, for example, are arranged.

Between the inner stator 311 and the outer stator 312, the magnet coil 320 may be accommodated and a space 302 communicating with the air gap 310*a* may be formed. Wound grooves 311*a* and 312*a* inwardly recessed to form the space 302 on a facing side may be formed in at least one of the inner stator 311 or the outer stator 312. A size of the space 302 or the wound grooves 311*a* and 312*a* may be determined in proportion to an amount of the wound magnet coil 320.

A yoke 312*b* forming a magnetic path and a pole 312*c* which extends beyond a width of the yoke 312*b* and to which the magnet 330 may be fixed may be formed in at least one of the inner stator 311 or the outer stator 312. The pole 312*c* may have a length identical to or slightly larger than a length of the fixed magnet 330.

A stiffness, an alpha valve (a thrust constant of a motor), and a change rate of the alpha valve, for example, may be determined by a combination of the yoke 312*b* and the pole 312*c* which have been described above. Further, lengths and shapes of the yoke 312*b* and the pole 312*c* may be determined in various ranges according to a design of a product to which the corresponding linear motor is applied.

The magnet 330 may be fixed to at least one of the inner stator 311 or the outer stator 312. The magnet 330 may include a permanent magnet. For example, the magnet 330 may be configured as a single magnet having one pole or by coupling a plurality of magnets having three poles.

The magnet 330 may be spaced apart from the magnet coil 320 in a reciprocating direction of the mover 340 which will be described hereinafter. That is, the magnet 330 and the magnet coil 320 may be arranged so as not to overlap with each other in a radial direction of the stator 310.

In the related art, the magnet 330 and the magnet coil 320 have no choice but to overlap with each other in the radial direction of the stator 310, and accordingly the diameter of the motor has no choice but to increase. On the other hand, in embodiments disclosed herein, because the magnet 330 and the magnet coil 320 are spaced apart from each other in the reciprocating direction of the mover 340, the diameter of the motor may be reduced as compared to the related art.

Further, the magnet 330 may be formed such that different poles are arranged in the reciprocating direction of the mover 340. For example, the magnet 330 may include a 2-pole magnet in which an N pole and an S pole are formed on opposite sides in the same length. The magnet 330 may be exposed to the air gap 310*a*.

Although it is illustrated in this embodiment that the magnet 330 is fixed only to the outer stator 312, embodiments are not limited thereto. For example, the magnet 330 may be fixed only to the inner stator 311 or may be fixed to both the outer stator 312 and the inner stator 311.

The mover 340 may be formed of a magnetic material, and may reciprocate with respect to the stator 310 and the magnet 330. The mover 340 may be arranged in the air gap 310*a* to which the magnet 330 is exposed. The mover 340 may be spaced apart from the magnet coil 330 by a predetermined distance.

The mover 340 may include a movable core 341 arranged in the air gap 310*a*, formed of a magnetic material, and reciprocating with respect to the stator 310 and the magnet 330. The mover 340 may further include a connection member or connector 342 that supports the movable core 341 such that the movable core 341 is inserted into the air gap 310*a* toward the magnet 330.

For example, the connection member 342 may have a cylindrical shape, and the movable core 341 may be fixed to an inner surface or an outer surface of the connection member 342. The connection member 342 may be formed, for example, of a non-magnetic material so as not to affect flow of a magnetic flux. As above, when the movable core 342 is fixed to the connection member 342 to be inserted into the air gap 310*a*, a magnetic air gap between the magnet 330 and the movable core 341 may be reduced to a minimum.

According to this embodiment, the motor 300 reciprocates by a reciprocating centering force generated between the stator 310 and the magnet 330 provided in the magnet coil 320, and the mover 340. The reciprocating centering force refers to a force allowing the mover 340 to move toward a side where a magnetic energy (a magnetic potential energy and a magnetic resistance) is low when the mover 340 moves in a magnetic field, and this force forms a magnetic spring.

Thus, in this embodiment, when the mover 340 reciprocates by a magnetic force by the magnet coil 320 and the magnet 330, the mover 340 accumulates a force of returning to a center by the magnetic spring, and the mover 340 consistently reciprocates while resonating due to the force accumulated in the magnetic spring.

In this embodiment, the connection member 342 is coupled to the flange 132 of the piston 130. Thus, when the mover 340 reciprocates, the piston 130 coupled to the connection member 342 linearly reciprocates together.

Hereinafter, an operation of the above-described motor according to this embodiment will be described with reference to the accompanying drawings.

Figure 5:
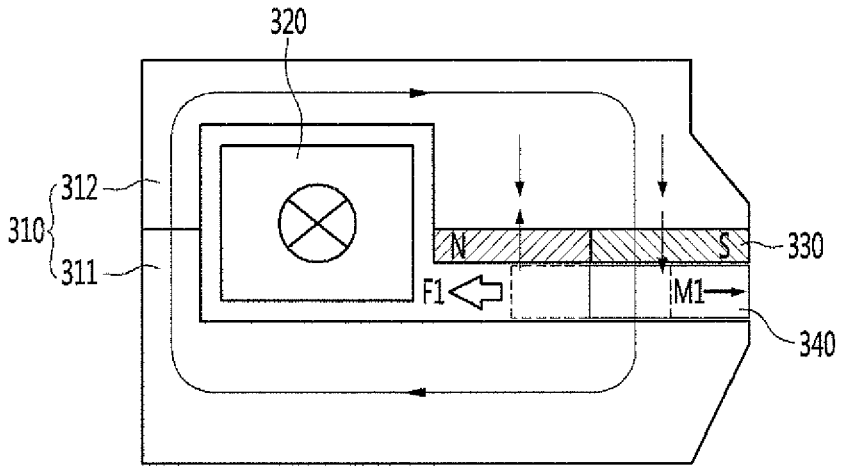
FIGS. 5 and 6 are views illustrating an operation of the linear motor according to an embodiment.
Figure 6:
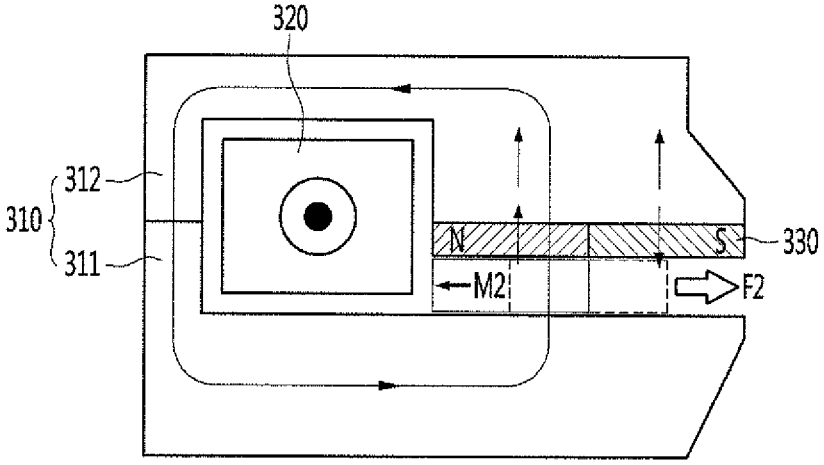

FIGS. 5 and 6 are views illustrating an operation of the linear motor according to an embodiment. First, when an alternating current is applied to the magnet coil 320 of the motor, an alternating magnetic flux is formed between the inner stator 311 and the outer stator 312. In this case, the mover 340 consistently reciprocates while moving in opposite directions along a magnetic flux direction.

A magnetic resonance spring is formed between the mover 340, the stator 310, and the magnet 330 inside the linear motor, to induce a resonance motion of the mover 340. For example, as illustrated in FIG. 5, in a state in which the magnet 330 is fixed to the outer stator 312 and a magnetic flux by the magnet 330 flows in a clockwise direction in the drawings, when the alternating current is applied to the magnet coil 320, the magnetic flux by the magnet coil 320 flows in the clockwise direction in the drawings. Further, the mover 340 moves in a rightward direction (see arrow M1) of the drawing in which the magnetic flux by the magnet coil 320 and a magnetic flux of the magnet 330 increase.

A reciprocating centering force F1 of returning to a left side in the drawing where a magnetic energy (that is, a magnetic potential energy or magnetic resistance) is low is accumulated between the mover 340 and the stator 310 and the magnet 330. In this state, as illustrated in FIG. 6, when a direction of the current applied to the magnet coil 320 changes, the magnetic flux by the magnet coil 320 flows in a counterclockwise direction of the drawing, and the magnetic flux by the magnet coil 320 and the magnetic flux of the magnet 330 increase in a reverse direction, that is, in a leftward direction in the drawing. The mover 340 moves to the left side (see arrow M2) in the drawing by the accumulated reciprocating centering force F1 and a magnetic force by the magnetic flux of the magnet coil 320 and the magnet 330. In this process, the mover 340 further moves to the left side of the drawing via the center of the magnet 330 by an inertial force and the magnetic force.

Likewise, a reciprocating centering force of returning to the center of the magnet 330 where the magnetic energy is low, that is, to a right side in the drawing, is accumulated between the mover 340, and the stator 310 and the magnet 330. Referring back to FIG. 5, when a direction of the current applied to the magnet coil 320 changes, the mover 340 moves to the center of the magnet 330 by the accumulated reciprocating centering force F2 and the magnetic force by the magnetic flux of the magnet coil 320 and the magnet 330.

Also, the mover 340 further moves to the right side of the drawing via the center of the magnet 330 by an inertial force and the magnetic force. Further, the reciprocating centering force of returning to the center of the magnet 330 where the magnetic energy is low, that is, to a left side of the drawing, is accumulated between the mover 340, and the stator 310 and the magnet 330. In this manner, the mover 340 may consistently repeat a reciprocating motion in which the mover 340 alternately moves to the right side and the left side of the drawing, which is like a case where a mechanical resonance spring is provided.

Hereinafter, a discharge cover according to an embodiment will be described with reference to the accompanying drawings.

Figure 7:
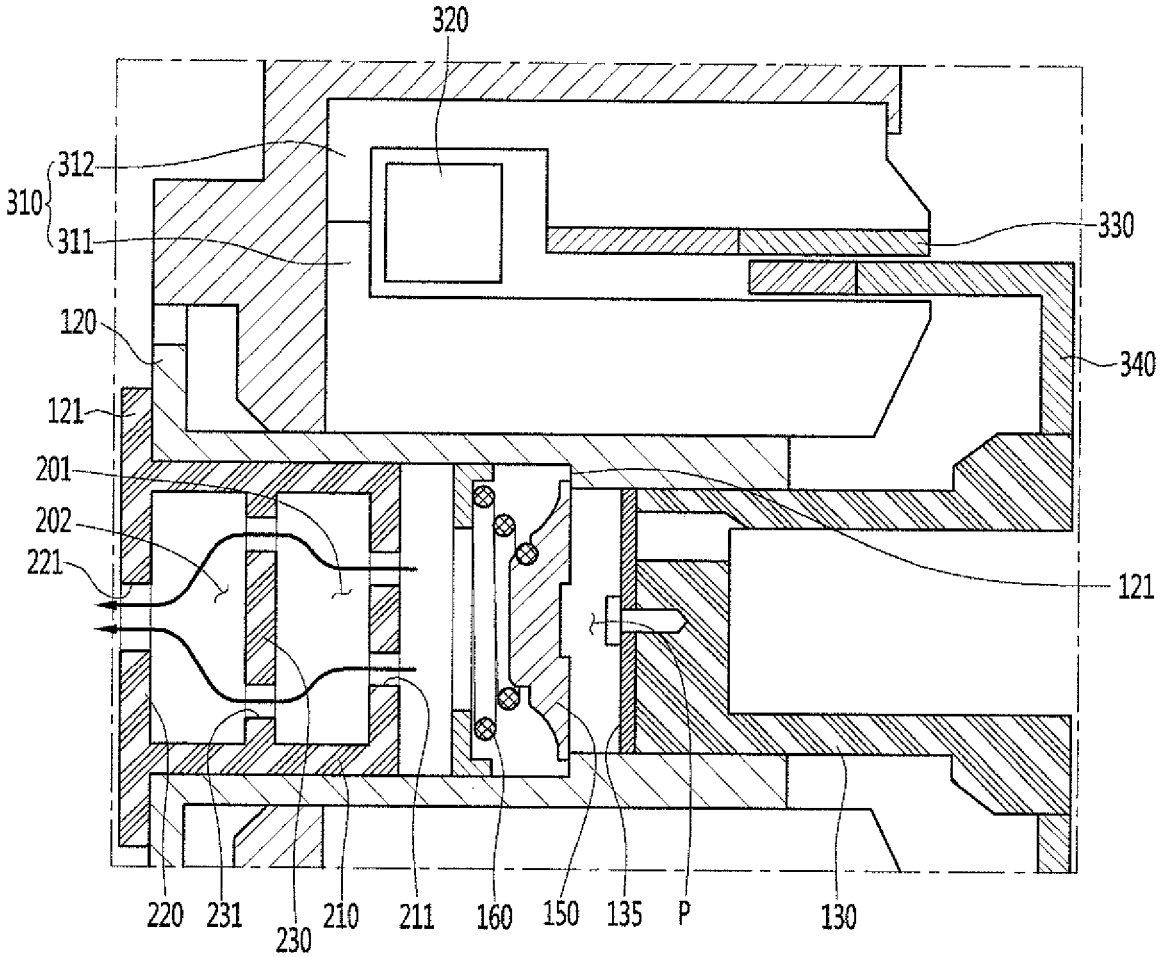
FIG. 7 is a partially enlarged view illustrating portion A of FIG. 2.

FIG. 7 is a partially enlarged view illustrating portion A of FIG. 2. FIG. 7 is a sectional view of a discharge cover, the discharge valve, and cylinder according to an embodiment.

Referring to FIG. 7, the discharge cover 200 according to this embodiment is located inside the cylinder 120. The discharge cover 200 may be located inside the cylinder 120 to shield an open one or a first side of the cylinder 120. That is, opposite sides of the cylinder 120 are open, the discharge cover 200 may be inserted into the open one side of the cylinder 120, and the piston 130 may be inserted into the open other or a second side of the cylinder 120.

The discharge cover 200 may include a body 210 arranged inside the cylinder 120, and a cover 220 formed at an end of the body 210. The body 210 may have a cylindrical shape having one open surface and may be located inside the cylinder 120. The open surface of the body 210 may be formed on a left or first side of the body 210 with respect to FIG. 7.

Further, an outer diameter of the body 210 may be identical to or slightly smaller than an inner diameter of the cylinder 120. Thus, the body 210 may be inserted into the cylinder 120.

The body 210 may define the discharge spaces 201 and 202 through which the refrigerant discharged through the discharge valve 150 passes. A first through-hole 211 may be formed on a surface of the body 210, which faces the discharge valve 150.

The first through-hole 211 may be understood as a hole through which the refrigerant is introduced into the body 210. One or a plurality of the first through-hole 211 may be provided. When a plurality of the first through-hole 211 is provided, the plurality of first through-holes 211 may be spaced apart from each other in a circumferential direction.

The discharge cover 200 may further include a partition portion or partition 230 arranged inside the body 210. The partition portion 230 may be located inside the body 210 to partition the discharge spaces 201 and 202 of the body 210 into first discharge space 201 and second discharge space 202. Thus, the refrigerant having passed through the first through-holes 211 may be first introduced into the first discharge space 201.

For example, the partition portion 230 may integrally extend from an inner circumferential surface of the body 210. Alternatively, the partition portion 230 may be separately formed, and may be inserted into the body 210.

The partition portion 230 may have a circular plate shape. A second through-hole 231 may be formed in the partition portion 230.

The second through-hole 231 may be understood as a hole through which the refrigerant having passed through the first discharge space 201 is to be introduced into the second discharge space 202. One or a plurality of the second through-hole 231 may be provided. When a plurality of the second through-hole 231 is provided, the plurality of second through-holes 231 may be spaced apart from each other in a circumferential direction.

The second through-holes 231 may be arranged so as not to overlap with the first through-holes 211. That is, the second through-holes 231 may be arranged so as not to face the first through-holes 211.

If the first through-holes 211 and the second through-holes 231 are arranged to face each other or to overlap with each other, the refrigerant having passed through the first through-holes 211 may directly pass through the second through-holes 231, so that a flow distance of the refrigerant may be shortened. When the flow distance of the refrigerant is shortened, an effect of reducing flow noise of the refrigerant having passed through the discharge cover 200 may deteriorate. Thus, in order to increase the flow distance of the refrigerant, the first through-holes 211 and the second through-holes 231 may be arranged so as not to overlap with each other.

The cover 220 may serve to shield the open surface of the body 210 and fix the body 210 to the cylinder 120 or the frame 140. The cover 220 may have a disc shape to shield the open surface of the body 210. Further, the cover 220 may have a larger diameter than the diameter of the cylinder 120 to be fixed to one side of the cylinder 120.

A fixing scheme may correspond to fixing by a fastening member or fixing by adhesive, such as glue or a double-sided tape. That is, the cover 220 may be firmly fixed to the front surface of the cylinder 120.

Alternatively, not the cover 220 but the body 210 may be fixed to the cylinder 120. In this case, the body 210 may be closely inserted into the cylinder 120. Alternatively, the outer circumferential surface of the body 210 may be fixed to the inner circumferential surface of the cylinder 120 through adhesive. In this way, in this embodiment, at least one of the body 210 or the cover 220 may be fixed to the cylinder 120 or the frame 140.

The cover 220 may be formed integrally with the body 210. Alternatively, the cover 220 may be separately formed, and may be fixed to the body 210 through a welding scheme, for example.

An insertion hole 221 into which a cover pipe 203 configured to discharge the refrigerant having passed through the discharge spaces 201 and 202 may be inserted may be formed in the cover 220. The insertion hole 221 may be formed to pass through a portion of the cover 220, and the cover pipe 203 may be inserted into the insertion hole 221.

Hereinafter, flow of the refrigerant in the linear compressor according to an embodiment will be described with reference to FIGS. 2 and 7.

First, the refrigerant suctioned into the shell 101 through the suction pipe 104 may be introduced into the piston 130 via the suction muffler. The piston 130 may axially reciprocate by driving of the motor 300.

Further, when the suction valve 135 coupled to a front portion of the piston 130 is opened, the refrigerant may be introduced into the compression space P of the cylinder 120 and compressed. Further, when the discharge valve 150 is opened, the compressed refrigerant may be introduced into the discharge spaces 201 and 202 of the discharge cover 200.

The discharge valve 150 may move to become far away from the piston 130, so that a gap may be formed between the discharge valve 150 and the stepped portion 121. Further, the refrigerant may pass through the gap, and sequentially pass through the first discharge space 201 and the second discharge space 202 of the discharge cover 200. In this process, flow noise of the refrigerant having passed through the discharge spaces 201 and 202 may be reduced.

The refrigerant having passed through the discharge space 201 and 202 may be discharged to the cover pipe 203 coupled to the insertion hole 221. Further, the refrigerant having been discharged to the cover pipe 203 may be discharged to the outside of the linear compressor 10 via the loop pipe (not illustrated) and the discharge pipe 105.

In embodiment, discharge components (for example, the discharge valve, the spring assembly, and the discharge cover, for example) for discharging the refrigerant compressed by the cylinder may be located inside the cylinder. Thus, a length of the piston may be significantly reduced as compared to the related art and a weight of the piston may be reduced as well, so that a high-speed operation of the compressor is advantageous.

Further, as the length of the piston inserted into the cylinder is significantly reduced, a center of a supporting force of a bearing supporting the piston and a center of an eccentric force generated when the piston reciprocates coincide with each other, so that stable movement of the piston may be achieved. Accordingly, occurrence of vibration or noise according to the reciprocating movement of the piston may be reduced.

Further, in a state in which the outer diameter of the motor is limited, the length of the piston is shortened, so that a cross section of the magnet coil may increase relatively. That is, even while the outer diameter of the motor is maintained, the output of the motor may increase.

Figure 8:
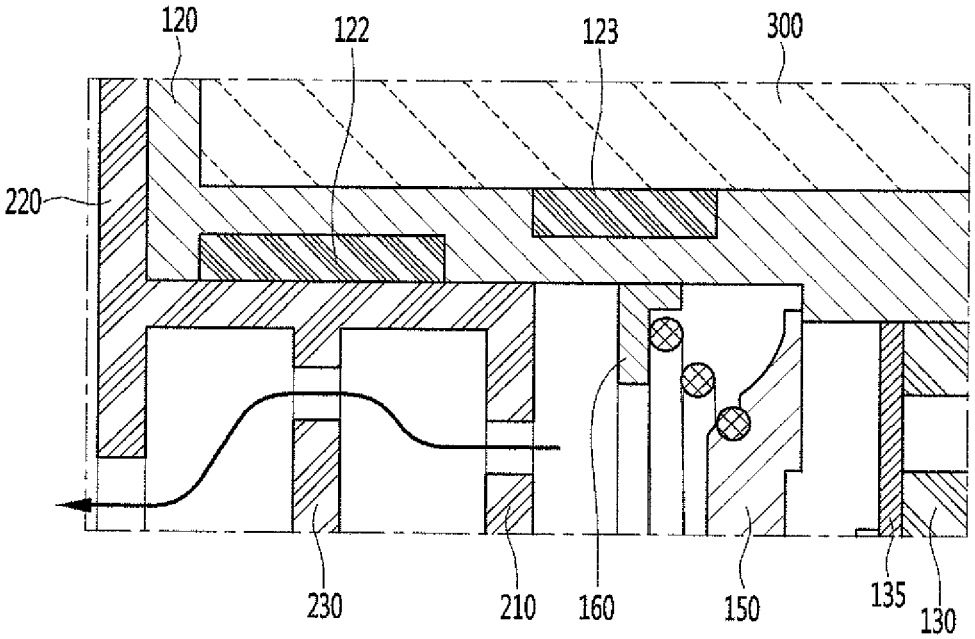
FIG. 8 is a sectional view of a cylinder which is a component of the linear compressor according to another embodiment.

FIG. 8 is a sectional view illustrating another example of a cylinder which is a component of the linear compressor according to another embodiment. This embodiment is different from the embodiment of FIG. 7 in terms of a shape of the cylinder, and is the same as FIG. 7 in terms of other components. Thus, only characteristic components of this embodiment will be described hereinafter, and the same parts as those of FIG. 7 will be cited again.

Referring to FIG. 8, because the discharge cover 200 through which the high-temperature, high-pressure refrigerant passes is located inside the cylinder 120, the discharge cover 200 may be located to be adjacent to the motor 300. In this case, while the high-temperature, high-pressure refrigerant passes through the discharge cover 200, high-temperature heat may be transferred to the motor 300 through the cylinder 120.

The high-temperature heat may be transferred to the magnet coil 320 wound on the inner stator 311 or arranged to be adjacent to the inner stator 311. That is, the discharge cover 200 may be located inside the cylinder 120, so that the temperature of the magnet coil 320 may increase by heat of the refrigerant passing through the discharge cover 200.

When the temperature of the magnet coil 320 increases, a high-speed operation of the motor becomes difficult and an operation of the motor becomes unstable, and thus, efficiency of the motor deteriorates. Thus, to solve the above problem, in this embodiment, a heat blocking member or shield 122 may be provided at a portion where the cylinder 120 and the discharge cover 200 are in contact with each other. Alternatively, a heat blocking member or shield 123 may be provided at a portion where the cylinder 120 and the inner stator 311 are in contact with each other.

The heat blocking members 122 and 123 may be arranged at any point of the inner circumferential surface or the outer circumferential surface of the cylinder 120. The heat blocking members 122 and 123 may be formed of a material having a heat blocking effect. For example, although the heat blocking members 122 and 123 may be formed of synthetic resin, silicone, or rubber, for example, embodiments are not limited thereto.

According to this embodiment, the heat blocking members 122 and 123 may be interposed in or at a portion where the cylinder 120 and the discharge cover 200 are in contact with each other or a portion where the cylinder 120 and the inner stator 311 are in contact with each other. For example, the heat blocking members 122 and 123 may be arranged to be buried in the inner circumferential surface or the outer circumferential surface of the cylinder 120. As another example, the heat blocking members 122 and 123 may be arranged to be applied to a portion where the cylinder 120 is in contact with the discharge cover 200 or the inner stator 311. That is, an outer portion of the cylinder 120 may be coated with a material having a heat blocking effect.

Alternatively, the heat blocking members may be omitted and an empty space may exist in the cylinder, so that heat transfer to the motor may be minimized. That is, a space where the heat blocking members are located is emptied, so that heat transferred to the motor may be dissipated through the space.

Although not illustrated, a sealing member or seal that prevents the refrigerant flowing through the discharge cover 200 from leaking may be provided on the inner circumferential surface or the outer circumferential surface of the cylinder 120. That is, the sealing member may be interposed between the inner circumferential surface of the cylinder 120 and the outer circumferential surface of the discharge cover 200. Alternatively, the sealing member may be interposed between the outer circumferential surface of the cylinder 120 and the inner circumferential surface of the inner stator 311. Thus, the refrigerant flowing through the discharge cover 200 may be prevented from being moved to the motor through the cylinder 120.

Figure 9:
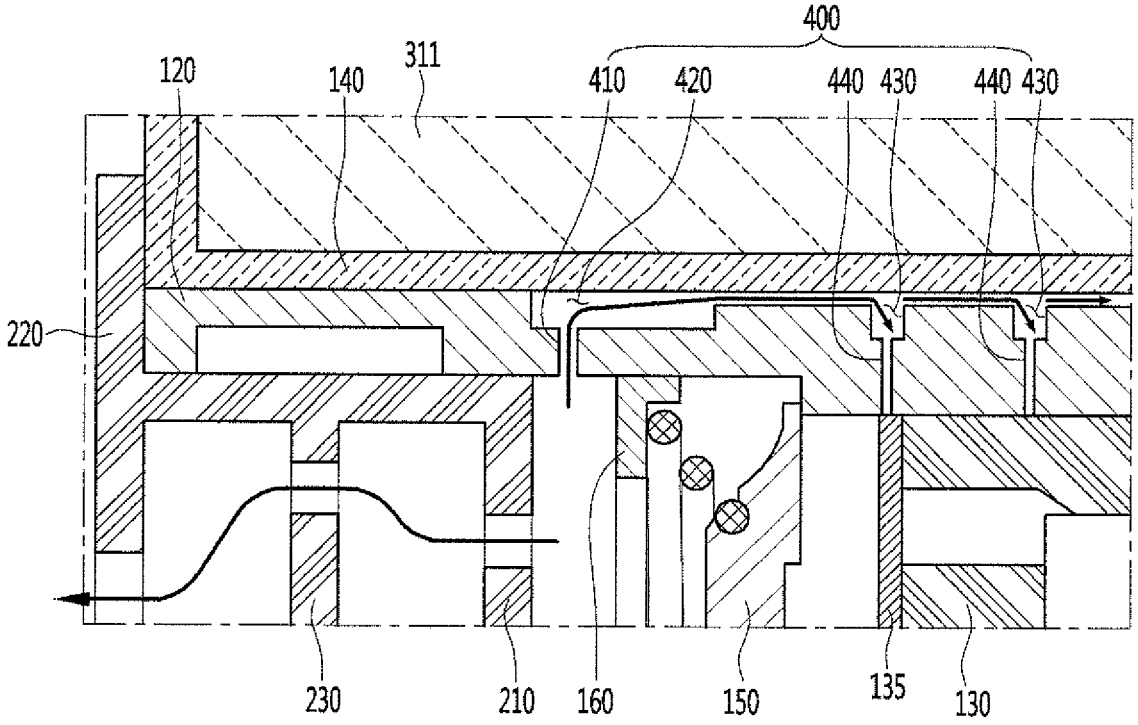
FIG. 9 is a sectional view of a cylinder which is a component of the linear compressor according to another embodiment.

FIG. 9 is a sectional view of a cylinder which is a component of the linear compressor according to another embodiment. This embodiment is different from that of FIG. 7 in that a gas bearing is formed inside the cylinder, and is the same as FIG. 7 in terms of other components. Thus, only characteristic components of this embodiment will be described, and the same components as those of FIG. 7 will be cited again.

Referring to FIG. 9, a gas bearing 400 configured to provide a lifting force to the piston 130 may be formed in the cylinder 120 according to this embodiment. The gas bearing 400 may be understood as a component configured to achieve a bearing function for the piston by a gas refrigerant by providing a lifting force to the piston 130 without using oil.

In this embodiment, the frame 140 may be configured to support the inner stator 311. That is, the frame 140 may be located between the outer surface of the cylinder 120 and the inner surface of the inner stator 311. Thus, the gas refrigerant discharged through the discharge valve 150 may be prevented from being introduced into the motor.

The gas bearing 400 may include a gas inlet hole 410, a gas communication passage 420, gas inlets 430, and gas outlet holes 440. The gas inlet hole 410 may be an entrance through which the gas refrigerant discharged by the discharge valve 150 is introduced into the cylinder 120.

For example, the gas inlet hole 410 may be formed on the inner circumferential surface of the cylinder 120, which corresponds to a portion between the spring assembly 160 and the discharge cover 200. Thus, a part or portion of the gas refrigerant discharged through the discharge valve 150 may be introduced into the gas inlet hole 410.

The gas communication passage 420 may be formed as a part or portion of the outer circumferential surface of the cylinder 120 which is recessed. The gas communication passage 420 may communicate with the gas inlet hole 410 and may communicate with the plurality of gas inlets 430 which will be described hereinafter.

For example, the gas communication passage 420 may be recessed radially inward from the outer circumferential surface of the cylinder 120. Further, the gas communication passage 420 may be formed to have a cylindrical shape along the outer circumferential surface of the cylinder 120 with respect to an axial center line.

On the other side, the gas communication passage 420 may have a space that communicates with the gas inlet hole 410 and an extension that extends from the space toward the piston 130.

The gas inlets 430 correspond to a space where the gas refrigerant having flowed through the gas communication passage 420 flows. The gas inlets 430 may be recessed radially inward from the outer circumferential surface of the cylinder 120. Further, the gas inlets 430 may be formed to have a circular shape along the outer circumferential surface of the cylinder 120 with respect to an axial center line.

A plurality of the gas inlets 430 may be provided. The plurality of gas inlets 430 may be branched from the gas communication passage 420.

The gas outlet holes 440 may be recessed radially inward from the gas inlets 430. That is, the gas outlet holes 440 may extend to the inner circumferential surface of the cylinder 120.

The gas refrigerant having passed through the gas outlet holes 440 may be introduced into a space between the inner circumferential surface of the cylinder 120 and the outer circumferential surface of the piston body 131. Thus, the gas refrigerant flowing to the outer circumferential surface of the piston body 131 through the gas outlet holes 440 may function as a gas bearing for the piston 130 by providing a lifting force to the piston 130. That is, a bearing function for the piston 130 may be achieved by the gas refrigerant without using oil.

According to embodiments disclosed herein, the entire length of the piston may be reduced as the axial length of the motor is reduced. Accordingly, it is advantageous in a high-speed operation, and power consumption according to an operation of the motor may be reduced.

Further, because the axial length of the motor is reduced, the cross section of the magnet coil may increase while the outer diameter of the motor is maintained, so that the output of the motor may increase. Furthermore, as the length of the piston is reduced, the center of a supporting force of a bearing supporting the piston and the center of an eccentric force generated when the piston reciprocates coincide with each other, so that stable movement of the piston may be achieved.

Because the refrigerant discharged through the discharge valve may be prevented from leaking to the motor, compression efficiency of the refrigerant may be improved. Also, because the discharge cover through which the refrigerant discharged through the discharge valve passes is simply mounted and separated, maintenance of the discharge cover may be easy.

Because high-temperature heat of the refrigerant passing through the discharge cover is prevented from being transferred to the motor through the cylinder, the motor may be stably driven, and efficiency of the motor may be improved. Additionally, because a lifting force may be provided to the piston without using oil, a bearing function for the piston may be achieved by the gas refrigerant.

Embodiments disclosed herein provide a linear compressor which may reduce an entire length of a piston by reducing a length of a motor in an axial direction. Embodiments disclosed herein further provide a linear compressor which reduces power consumption for a reciprocating motion of a piston by reducing a weight of the piston, and thereby improving efficiency of a motor and is advantageous in a high-speed operation.

Embodiments disclosed herein provide a linear compressor which may increase an output of a motor by increasing a cross section of a magnet coil while an outer diameter of the motor is maintained. Embodiments disclosed herein provide a linear compressor which allows the center of a support force of a bearing portion, which supports a piston, and a center of an eccentric force generated when the piston reciprocates to coincide with each other, thereby enabling stable movement of the piston.

Embodiments disclosed herein also provide a linear compressor in which a refrigerant discharged through a discharge valve may be prevented from leaking toward a motor. Embodiments disclosed herein provide a linear compressor in which a discharge cover through which a refrigerant discharged through a discharge valve may be mounted and separated.

Embodiments disclosed herein provide a linear compressor in which high-temperature heat of a refrigerant passing through a discharge cover is prevented from being transferred to a motor through a cylinder. Embodiments disclosed herein further provide a linear compressor which may achieve a bearing function for a piston by a gas refrigerant by providing a lifting force to the piston without using oil.

A linear compressor according to embodiments disclosed herein may include a cylinder, a piston that reciprocates inside the cylinder in an axial direction, a motor configured to provide a driving force to the piston, a suction valve configured to suction the refrigerant to a compression space of the cylinder, a discharge valve configured to discharge the refrigerant compressed in the compression space of the cylinder, and a discharge cover having a discharge space therein in which the refrigerant discharged through the discharge valve flows. At least one of the suction valve or the discharge valve, and the discharge cover may be arranged inside the motor, so that an axial length of the motor may be reduced, and accordingly an entire length of the piston may be reduced. For example, at least one of the suction valve or the discharge valve, and the discharge cover may be located inside the cylinder. When a length of the piston is reduced, a center of a supporting force of a bearing supporting the piston and the center of an eccentric force generated when the piston reciprocates coincide with each other, so that stable movement of the piston may be achieved.

As the length of the piston is reduced, a cross section of the magnet coil provided in the motor may increase even while an outer diameter of the motor is maintained, so that the output of the motor may increase.

According to embodiments disclosed herein, an outer circumferential surface of the discharge valve may be spaced apart from an inner circumferential surface of the cylinder and the outer circumferential surface of the discharge cover may be in contact with the inner circumferential surface of the cylinder, so that the refrigerant discharged through the discharge valve may be prevented from leaking to the motor.

According to embodiments disclosed herein, the discharge cover may include a body inserted into the cylinder and a cover further extending radially from an end of the body. The cover may be fixed to one side of the cylinder through a fastening member or may be fixed to one side of the frame supporting the motor through a fastening member. Thus, the discharge cover may be easily mounted on or separated from the cylinder or the frame.

According to embodiments disclosed herein, in the linear compressor, because a heat blocking member may be provided between the discharge cover and the cylinder or may be provided between the cylinder and the motor, high-temperature heat of the refrigerant passing through the discharge cover may be prevented from being transferred to the motor through the cylinder.

According to embodiments disclosed herein, the cylinder may have a gas bearing including a gas inlet hole through which a part of the refrigerant discharged through the discharge valve is introduced, a gas communication passage through which a refrigerant gas introduced through the gas inlet hole flows, and a gas outlet hole through which the refrigerant gas flowing through the gas communication passage is discharged to the piston. Thus, because a lifting force may be provided to the piston without using oil, a bearing function for the piston may be achieved by the gas refrigerant.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a motor;

a frame that supports the motor, at least a portion of the frame is disposed inside of the motor;

a cylinder that defines a compression space for a refrigerant, wherein the cylinder is disposed inside of the frame;

a piston that axially reciprocates inside of the cylinder;

a suction valve configured to suction the refrigerant into the compression space;

a discharge valve configured to discharge the refrigerant compressed in the compression space; and a discharge cover having a discharge space into which the refrigerant discharged through the discharge valve flows, wherein the suction valve, the discharge valve, and at least a portion of the discharge cover are disposed inside of the motor, wherein a gas bearing is provided in the cylinder, wherein a portion of the refrigerant discharged through the discharge valve passes through the gas bearing and flows into a gap between the piston and the cylinder, wherein the gas bearing comprises:

a gas inlet hole through which the portion of the refrigerant discharged through the discharge valve is introduced;

a gas communication passage that communicates with the gas inlet hole; and at least one gas outlet hole branched from the gas communication passage, and wherein the at least one gas inlet hole is formed on an inner circumferential surface of the cylinder.

2. The linear compressor of claim 1, wherein the at least one gas inlet hole is formed in the inner circumferential surface of the cylinder corresponding to a portion between the discharge cover and the discharge valve.

3. The linear compressor of claim 1, wherein the gas communication passage comprises a recess formed in an outer circumferential surface of the cylinder.

4. The linear compressor of claim 3, wherein the gas communication passage has a cylindrical shape along the outer circumferential surface of the cylinder with respect to an axial centerline of the cylinder.

5. The linear compressor of claim 1, wherein the gas communication passage includes a space that communicates with the at least one gas inlet hole and an extension that extends from the space toward the piston.

6. The linear compressor of claim 1, wherein at least one gas inlet extends in a radial direction between the gas communication passage and the at least one gas outlet hole.

7. The linear compressor of claim 6, wherein the at least one gas outlet hole extends between the at least one gas inlet and an inner circumferential surface of the cylinder.

8. The linear compressor of claim 6, wherein at least one gas inlet has a circular shape along an outer circumferential surface of the cylinder with respect to an axial center line of the cylinder.

9. The linear compressor of claim 1, wherein the discharge cover is disposed at least partially inside of the frame.

10. The linear compressor of claim 9, wherein the discharge cover is disposed at least partially inside of the cylinder.

11. The linear compressor of claim 1, wherein the suction valve and the discharge valve are disposed inside of the frame.

12. The linear compressor of claim 11, wherein the suction valve and the discharge valve are disposed inside of the cylinder.

13. The linear compressor of claim 1, wherein the compressor further comprises a spring assembly that elastically supports the discharge valve, and wherein the spring assembly is disposed inside of the cylinder.

14. The linear compressor of claim 13, wherein the spring assembly is disposed between the discharge valve and the discharge cover.

15. The linear compressor of claim 1, wherein the discharge valve is disposed in a stepped portion formed by a difference in an inner diameter of the cylinder.

* * * * *